US008418711B2

(12) United States Patent
Park et al.

(10) Patent No.: US 8,418,711 B2
(45) Date of Patent: Apr. 16, 2013

(54) COLLAPSIBLE CANOPY SUPPORT STRUCTURE

(75) Inventors: Bumjun Park, Suzhou (CN); Won Sik Kim, Taiping Zhen (CN); Martin James Dotterweich, Escondido, CA (US); Rusty George Summar, Brenham, TX (US)

(73) Assignee: HKD International (HK) Limited, Hong Kong (HK)

( * ) Notice: Subject to any disclaimer, the term of this patent is extended or adjusted under 35 U.S.C. 154(b) by 0 days.

(21) Appl. No.: 12/307,697

(22) PCT Filed: Jul. 5, 2007

(86) PCT No.: PCT/US2007/072859

§ 371 (c)(1),
(2), (4) Date: Sep. 9, 2009

(87) PCT Pub. No.: WO2008/006022

PCT Pub. Date: Jan. 10, 2008

(65) Prior Publication Data

US 2010/0043856 A1 Feb. 25, 2010

Related U.S. Application Data

(60) Provisional application No. 60/819,282, filed on Jul. 6, 2006.

(51) Int. Cl.
*E04H 15/50* (2006.01)

(52) U.S. Cl.
USPC ..... 135/145

(58) Field of Classification Search ..... 135/120.1, 135/120.2, 143, 144, 145
See application file for complete search history.

(56) References Cited

U.S. PATENT DOCUMENTS

| | | | | |
|---|---|---|---|---|
| 1,666,757 | A * | 4/1928 | Snyder | 135/146 |
| 1,679,513 | A * | 8/1928 | Brown | 403/73 |
| 1,714,698 | A * | 5/1929 | Stoll | 403/100 |
| 2,230,454 | A | 2/1941 | Friesner et al. | |
| 2,704,963 | A * | 3/1955 | Parachek | 248/480 |
| 4,165,757 | A | 8/1979 | Marks | |
| 4,265,261 | A | 5/1981 | Barker | |
| 4,607,656 | A | 8/1986 | Carter | |
| 4,779,635 | A | 10/1988 | Lynch | |
| 4,838,293 | A | 6/1989 | Novak | |
| 4,876,829 | A | 10/1989 | Mattick | |
| 4,898,085 | A | 2/1990 | Jarnot | |
| 4,979,531 | A | 12/1990 | Toor et al. | |
| 5,005,322 | A | 4/1991 | Mattick et al. | |

(Continued)

OTHER PUBLICATIONS

Korean Intellectual Property Office: Technical Evaluation Decision "Automatic Tent with Snap Through" Application Date: Feb. 9, 2004.

(Continued)

*Primary Examiner* — Noah Chandler Hawk
(74) *Attorney, Agent, or Firm* — Polster, Lieder, Woodruff & Lucchesi, LC

(57) ABSTRACT

A collapsible canopy support includes beams for supporting a canopy with each beam having a plurality of elongated beam segments coupled together to form the beam. A segment coupler provides for pivotally coupling a first beam segment to a second beam segment. A segment locking assembly is adapted for selectively securing the first beam segment relative to the second beam segment.

38 Claims, 7 Drawing Sheets

U.S. PATENT DOCUMENTS

| | | | | |
|---|---|---|---|---|
| 5,467,794 | A | 11/1995 | Zheng | |
| 5,485,863 | A | 1/1996 | Carter | |
| 5,490,533 | A | 2/1996 | Carter | |
| 5,511,572 | A | 4/1996 | Carter | |
| 5,632,292 | A | 5/1997 | Carter | |
| 5,632,293 | A | 5/1997 | Carter | |
| 5,655,340 | A | 8/1997 | Pelsue | |
| 5,797,412 | A | 8/1998 | Carter | |
| 5,813,425 | A | 9/1998 | Carter | |
| 5,921,260 | A | 7/1999 | Carter | |
| 5,934,301 | A | 8/1999 | Carter | |
| 6,035,877 | A * | 3/2000 | Losi et al. | 135/131 |
| 6,035,887 | A | 3/2000 | Cato | |
| 6,041,800 | A | 3/2000 | Carter | |
| 6,070,604 | A | 6/2000 | Carter | |
| 6,076,312 | A | 6/2000 | Carter | |
| 6,089,247 | A | 7/2000 | Price | |
| 6,129,102 | A | 10/2000 | Carter | |
| 6,138,702 | A | 10/2000 | Carter | |
| 6,192,910 | B1 | 2/2001 | Carter | |
| 6,230,729 | B1 | 5/2001 | Carter | |
| 6,240,940 | B1 | 6/2001 | Carter | |
| 6,363,956 | B2 | 4/2002 | Carter | |
| 6,382,224 | B1 | 5/2002 | Carter | |
| 6,397,872 | B1 | 6/2002 | Carter | |
| 6,412,507 | B1 | 7/2002 | Carter | |
| 6,431,193 | B2 | 8/2002 | Carter | |
| 6,439,251 | B2 | 8/2002 | Carter | |
| 6,470,902 | B1 | 10/2002 | Carter | |
| 6,502,597 | B2 | 1/2003 | Carter | |
| 6,520,196 | B2 | 2/2003 | Carter | |
| 6,601,599 | B2 | 8/2003 | Carter | |
| D485,928 | S | 1/2004 | Leung et al. | |
| 6,679,643 | B1 | 1/2004 | Ham | |
| 6,701,949 | B2 | 3/2004 | Carter | |
| 6,708,707 | B2 | 3/2004 | Dotterweich et al. | |
| 6,712,083 | B2 | 3/2004 | Carter | |
| 6,718,995 | B2 | 4/2004 | Dotterweich | |
| 6,748,963 | B2 | 6/2004 | Carter | |
| 6,763,841 | B1 | 7/2004 | Cantwell | |
| 6,772,780 | B2 * | 8/2004 | Price | 135/131 |
| 6,796,320 | B2 | 9/2004 | Carter | |
| 6,868,858 | B2 | 3/2005 | Suh | |
| 6,874,520 | B2 | 4/2005 | Carter | |
| 6,899,112 | B2 * | 5/2005 | Tsai | 135/131 |
| 6,920,889 | B2 | 7/2005 | Carter | |
| 6,926,021 | B2 | 8/2005 | Carter | |
| 6,981,510 | B2 | 1/2006 | Carter | |
| 7,051,745 | B2 | 5/2006 | Carter | |
| 7,168,372 | B2 * | 1/2007 | Fotia | 108/80 |
| 7,178,541 | B2 | 2/2007 | Carter | |
| 7,178,542 | B2 | 2/2007 | Carter | |
| 7,182,092 | B1 | 2/2007 | Cantwell | |
| 7,311,113 | B2 * | 12/2007 | Suh | 135/145 |
| 7,703,469 | B2 * | 4/2010 | Danziger | 135/147 |
| 2004/0020369 | A1 | 2/2004 | Long et al. | |
| 2004/0020484 | A1 | 2/2004 | Skidmore et al. | |
| 2005/0120640 | A1 | 6/2005 | Cantwell | |
| 2006/0032524 | A1 | 2/2006 | Carter | |
| 2006/0118155 | A1 | 6/2006 | Carter | |
| 2006/0174929 | A1 | 8/2006 | Tseng | |
| 2007/0028954 | A1 | 2/2007 | Carter | |

OTHER PUBLICATIONS

Korean Intellectual Property Office (KR), Laid Open Patent Publication, "Automatic Tent with Snap-Thru", May 17, 2005.

* cited by examiner

COLLAPSIBLE CANOPY SUPPORT STRUCTURE

CROSS-REFERENCE TO RELATED APPLICATIONS

This application is a United States national phase under 35 USC §371 of PCT/US2007/072859, filed Jul. 5, 2007, which claims the benefit of U.S. Provisional Application No. 60/819,282, filed on Jul. 6, 2006 which is incorporated herein be reference. This application is also related co-pending application of PCT/US2007/073170 filed Jul. 10, 2007 and co-pending application of PCT/US2007/073176 filed Jul. 10, 2007.

FIELD

The present disclosure relates to collapsible structures and, more specifically, to a collapsible structural support for a canopy.

BACKGROUND

The statements in this section merely provide background information related to the present disclosure and may not constitute prior art.

There are a number of temporary shelters that can be transported and rapidly set up for a variety of uses. In general, these structures include an underlying supporting frame, which includes at least three and preferably four corner posts or legs. Commonly, the legs are in two parts arranged to telescope within one another so as to define a lower retracted position and an extended position for use. A side support brace structure is attached to each of the legs in an upper fixed position and at the lower position at a slider movably mounted on the leg. The slider moves with and on the leg to an extended position for erecting the canopy and use of the shelter. Typically, the side support structure conventionally is a scissors arrangement, which enables the legs and beam structure to be compressed for storage and in transport.

While current structures may work well for their intended purposes in many situations, they still encounter problems. Commonly, existing canopy support structures do not have lateral side supports that provide adequate stiffness to resist side forces such as wind. Thus, in heavy wind, they tend to move. Additionally, if the canopy support beams of conventional collapsible support structures are loaded, such as by roof loads or by hanging items thereon, the support beams either buckle downward, bow out, or are required to pivot out of the side lateral support structure, all of which are undesirable. The canopy support beams also provide a ceiling height to the structure and to the supported canopy. However, often loads placed on or near the center of such support beams can reduce the ceiling heights. Where prior art designs attempted to overcome one or more of these problems, those solutions resulted in additional cost and undesired complexity.

SUMMARY

The inventor hereof has succeeded at designing an improved canopy structure capable of having one or more improvements including a simplified construction, improved strength, and lower costs.

According to one aspect, a collapsible canopy support assembly includes a plurality of legs having upper and lower ends and a side support positioned between each adjacent leg. A plurality of beams having first and second ends is adapted for supporting a canopy. Each beam includes a plurality of elongated beam segments coupled together to form the beam. A segment coupler provides for pivotally coupling a first beam segment to a second beam segment. A segment locking assembly is adapted for selectively securing the first beam segment relative to the second beam segment. A hub is adapted for attaching to the first end of each canopy beam and securing the first ends of the beams relative to each other. A bracket is mounted to the upper end of each leg, the bracket having a base adapted for attaching to the leg and a coupler for attaching to the second end of a beam.

According to another aspect, a collapsible canopy support assembly includes means for pivotally coupling a first beam segment relative to a second beam segment and means for selectively securing the first beam segment relative to the second beam segment.

According to yet another aspect, a collapsible canopy support assembly has a plurality of legs having upper and lower ends, a side support positioned between each adjacent leg, and a plurality of beams having first and second ends and adapted for supporting a canopy. Each beam includes a plurality of elongated beam segments coupled together to form the beam. A bracket is mounted to the upper end of each leg and has a base adapted for attaching to the leg and a coupler for attaching to the second end of a beam. A hub is adapted for attaching to the first end of each canopy beam and releasably securing the first ends of the beams relative to each other. The assembly further includes a segment coupler for pivotally coupling a first beam segment relative to a second beam segment and a segment locking assembly adapted for selectively securing the first beam segment relative to the second beam segment.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

The following description is merely exemplary in nature and is not intended to limit the present disclosure or the disclosure's applications or uses.

Figure 1:
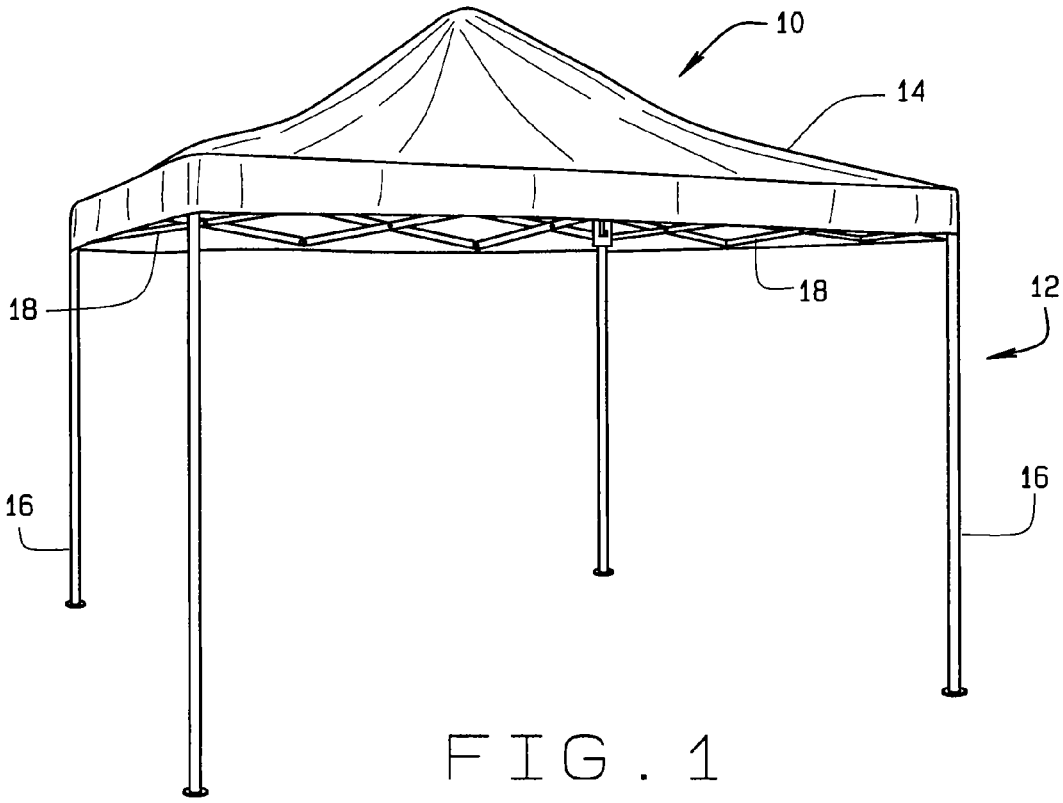
FIG. 1 is a side perspective view of an erected collapsible canopy shelter having a support beam structure according to one exemplary embodiment.

As shown in FIG. 1, a collapsible shelter 10 includes a canopy support structure or assembly 12 supporting a canopy 14. The canopy support assembly 12 includes a set of legs 16 that are connected by a side support 18. Such side supports 18 can be of any configuration and in some includes a scissors or x-shaped frame. In some embodiments, each side support 18 has first and second ends. As will be discussed by way of examples below, each end of the side support 18 includes an upper connector and a lower connector. A fixed support mounted near the top of each leg includes a first coupler for attaching the upper connector of the first side support and a second coupler for attaching the upper connector of the second side support. A slidable member is slidably connected to each leg and is movable between a first position for canopy storage and a second position for canopy erection or deployment. The slidable member has a first coupler for attaching the lower connector of the first side support and a second coupler for attaching the lower connector of the second side support.

Figure 2:
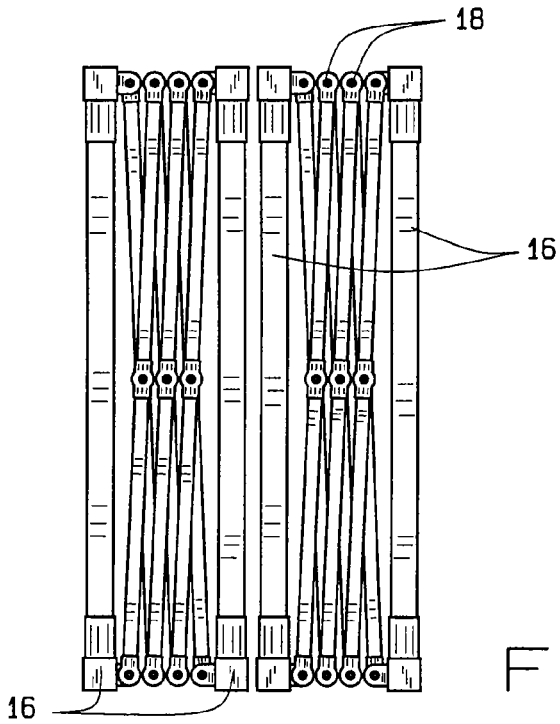
FIG. 2 is a side perspective view of a collapsed canopy shelter having a support beam structure according an exemplary embodiment.

Also, one or more canopy support beams (not shown in FIG. 1 support the canopy 14. The canopy support assembly 12 is shown in a collapsed position in FIG. 2.

Typically, the collapsible canopy support assembly 12 includes the legs 16 having an upper end 20 and a lower end 22 and the side supports 18 positioned between each adjacent leg 16. Canopy support beams 24 are adapted for supporting the canopy 14 and typically have first ends 26 and second ends 28. Each beam 24 includes two or more elongated beam segments 30 (shown as 30A and 30B by way of example) coupled together to form the beam 24.

Figure 4:
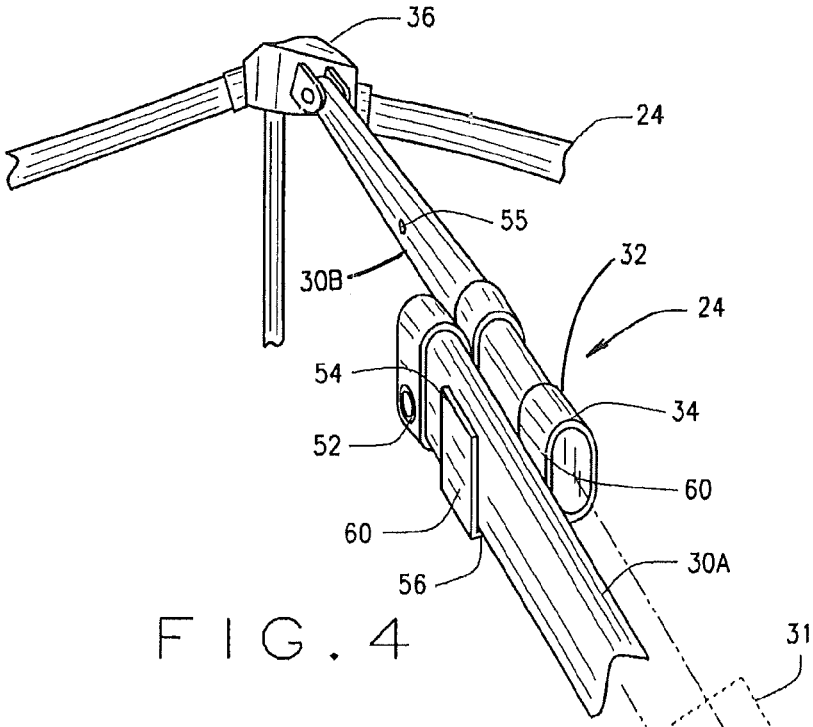
FIG. 4 is a perspective view of a canopy support structure having a canopy support beam with two segments and a hub according to another exemplary embodiment.
Figure 5:
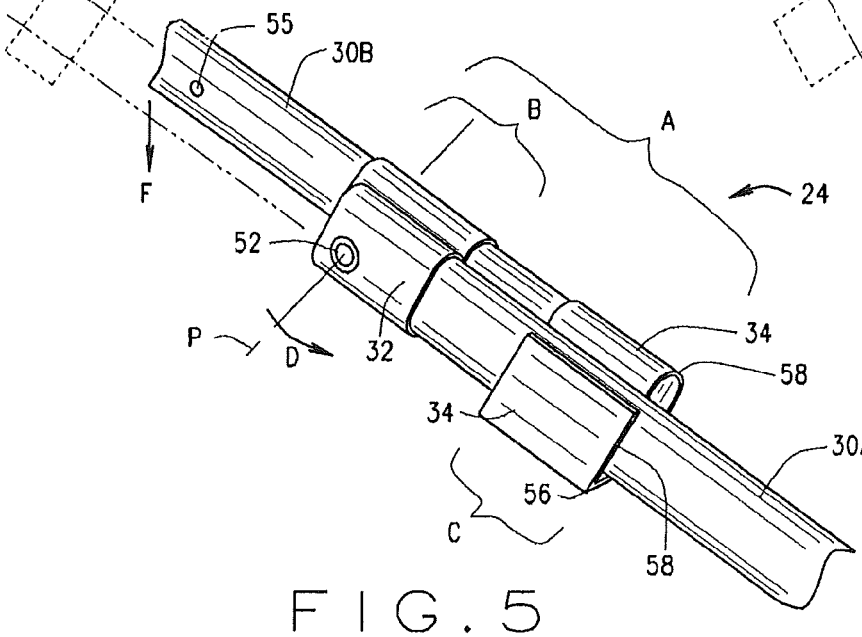
FIG. 5 is a side perspective view of a canopy support beam having two segments coupled with a pivotal segment coupler and a locking assembly according to the exemplary embodiment of FIG. 4.

Each pair of coupled beam segments are coupled by a segment coupler 32 in combination with a segment locking assembly 34. The segment coupler 32 provides for pivotally coupling a first beam segment 30A to a second beam segment 30B. The segment locking assembly 34 is adapted for selectively securing the first beam segment 30A relative to the second beam segment 30B. Such securing can provide for the continued pivotal movement of the first beam segment 30A past the second beam segment 30B or providing that the two coupled beam segments 30A and 30B are maintained adjacent each other in a substantially linear plane. The segment locking assembly 34 can also provide for restricting the lateral movement of one of the beam segments 30 relative to the coupled beam segment 30 when the canopy support assembly 12 is in the erected position, e.g., restricting movement laterally within a substantially planar position in a plane 31 that includes the first beam segment 30A and the second beam segment 30B (as shown in FIGS. 4 and 5) when the canopy support assembly 12 is erected, but not in the non-erected position. At the same time, the segment locking assembly 34 can provide for easy erecting and collapsing of the collapsible canopy support assembly 12 by continuing to allow pivoting of the first beam segment 30A relative to the second beam segment 30B about the pivotal segment coupler 32 in a direction suitable for such erecting and collapsing.

The segment coupler 32 and segment locking assembly 34 jointly operate to provide collapsible flexibility to the multi-segment beam 24 while also providing strength and restricted movement to the canopy support assembly 12 when erected and in response to external forces. As will be discussed further below, the arrangements of the segment coupler 32 and the segment locking assembly 34 can vary is design, arrangement and position and still be within the scope of the present disclosure.

A hub 36 can also be provided for attaching to the first end 26 of each canopy beam 24 and securing the first ends 26 of the beams 24 relative to each other. The hub 36 can be configured for releasably attaching to each beam 24 and/or for pivotally attaching to each beam 24.

A bracket 38 is mounted to the upper end 20 of each leg 16. The bracket 38 includes a base 40 and a beam coupler 42. The base 40 is adapted for attaching to the leg 16. The coupler 42 is adapted for coupling to the second end 28 of the beam 24. The coupler 42 can be fixed relative to the leg 16, fixed relative to the base 40, or can be pivotal about an axis defined by the leg 16 such as by a pivotable coupling between the coupler 42 and the base 40. Generally the bracket 38 is configured to attach the second end 28 of the beam 24 to the leg 16 in a fixed position relative to the axis of the leg 16 and/or to a perimeter defined by the legs 16 and the side supports 18, even though is may be pivotal about such axis. In other words, the bracket 38 may be configured to rotate about the axis of a leg 16, but not extend beyond a pivot so as to provide an adjustable outer perimeter defined by the brackets 38.

In some embodiments, a strut member 44 couples an intermediate portion of the each beam 24 to an intermediate portion of a leg 16. The strut member 44 can be pivotally coupled to the intermediate portion of each beam 24 and/or coupled to a sliding or adjustable member or coupler to the leg 16, such that the lower portion of the strut member 44 can move from a lower collapsed position to an upper erected position. The strut member 44 can be attached to the leg 16 by a pivotal coupler or can be manually attached to the leg 16 at the time of erection of the canopy support assembly 12. The strut member 44 can provide for supporting the beam 24 and in particular one or more beam segments 30A or 30B and for receiving a downward force applied to the beam 24 and transferring such downward force to the leg 16.

Figure 3:
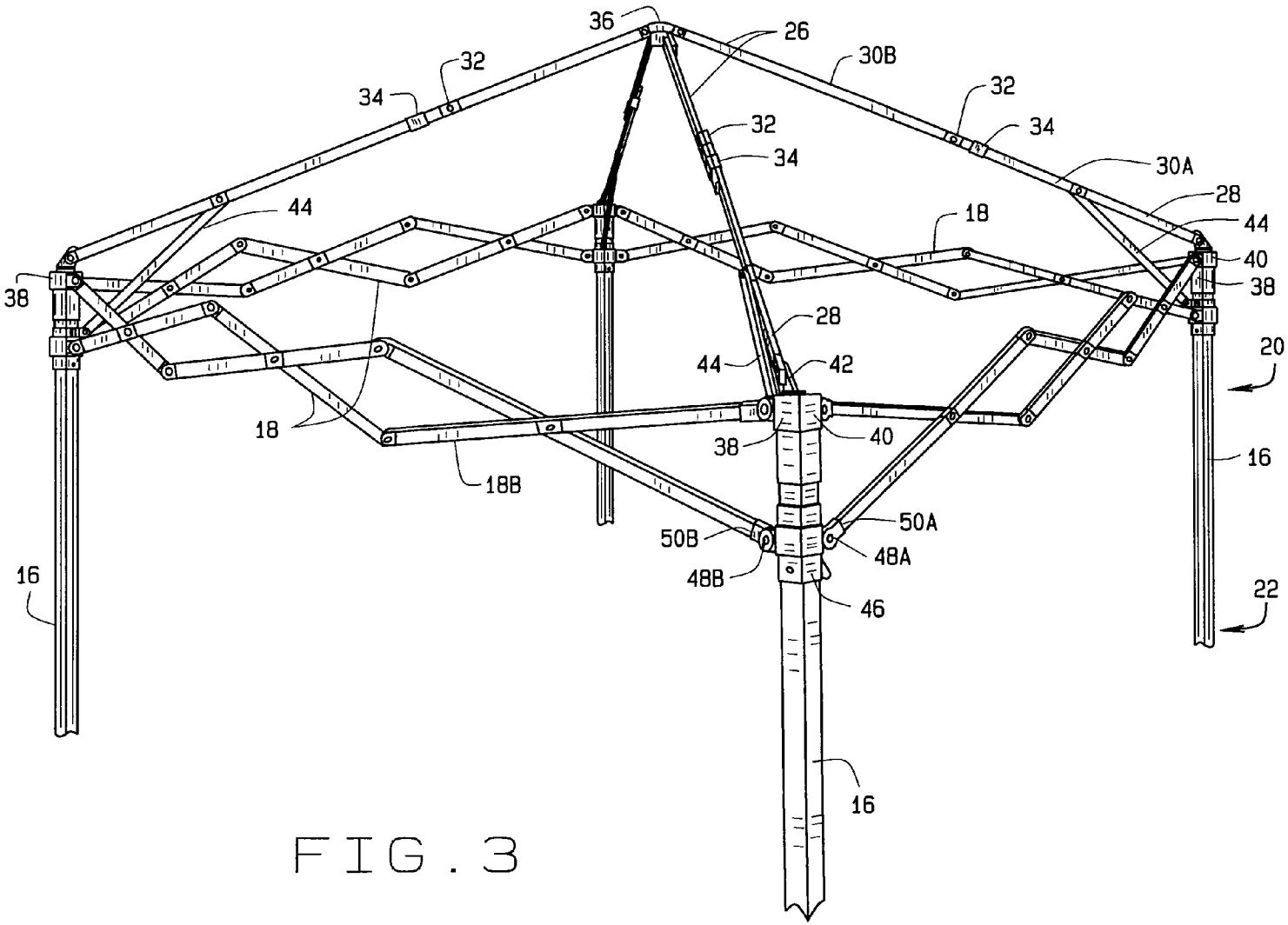
FIG. 3 is a side perspective view of an erected support structure with canopy support beams according to one exemplary embodiment.

In some embodiments, a sliding member 46 is coupled to each leg 16. Such sliding member 46 can be movable between a first lower position for canopy storage and a second higher position for erection of the canopy support assembly 12. The sliding member 46 also includes or interacts with a locking assembly (not shown) that locks the sliding member 46 is the second position for maintaining the canopy support assembly 12 in the erected position. The slidable member 46 can have a first coupler 48A for attaching a lower connector 50A of the first side support 18A and a second coupler 48B for attaching the lower connector 50B of the second side support 18B. When a strut member 44 is provided, the sliding member 46 can also include a third coupler (not shown in FIG. 3), for slidably attaching one end of the strut member 44 to the leg 16 and locking the strut member 44 is an erected position. The third coupler can include a pivotal coupling or a fixed coupling.

The strut member 44 can also include an adjustable coupler for attaching one end of the strut member 44 to multiple positions along the intermediate portion of the beam 24. In such embodiments, where an adjustable coupling of beam segments 30A and 30B can provide for varying length beams, the canopy support assembly 12 can provide for multiple peak heights of the assembled beams 24, the hub 36 and therefore the canopy 14 without affecting or requiring a change to the canopy perimeter defined by the legs 16 and the side supports 18.

As noted above, the segment coupler 32 and the segment locking assembly 34 can be have various embodiments for coupling and securing two beam segments 30 together. One such embodiment is illustrated in FIGS. 4 and 5. As shown, the first beam segment 30A is pivotally coupled to the second beam segment 30B by segment coupler 32. As shown, in this exemplary embodiment the segment locking assembly 34 is mounted about the end of the second beam segment 30B and the segment coupler 32 is mounted on the end of the first beam segment 30A. An overlap A is provided between the two beam segments 30. The segment coupler 32 pivotally attaches to an intermediate portion B of the second beam segment 30B.

The segment locking assembly 34 engages with an intermediate portion C of the first beam segment 30A that is distal from an end. The segment locking assembly 34 includes a saddle 54 as defined by a u-shaped or protruding finger or member 56 that is dimensioned for receiving and at least partially enclosing the intermediate portion C of the first beam segment 30A when the canopy support assembly 12 is in the erected position. The saddle 54 can be dimensioned to receive only a portion of the cross-section of the first beam segment 30A or can be a u-shaped channel configured to receive a substantial or complete portion of the cross-section of the first beam segment 30A. Additionally, while not illustrated in FIGS. 4 and 5, the saddle 54 can also include one or more mechanisms for selectably securing the intermediate portion C of the first beam segment 30A within the saddle 54 once it is received. The selectable securing mechanism can be configured to be user operated to release the secured beam segment 30 when the canopy support assembly 12 is to be collapsed.

The segment locking assembly 34 can be attached to the end of the second beam segment 30B by any suitable means, including the exemplary means as shown in FIGS. 4 and 5 where the segment locking assembly 34 includes an outer ring 58 that encircles the end of the second beam segment 30B. The segment locking assembly 34 can be attached to the second beam segment 30B by press fitting, welding, adhesives, and one or more fasteners, by ways of examples. The saddle 54 can also include sidewalls 60 that are adapted for preventing the lateral movement of the first beam segment 30A relative to the second beam segment 30B.

During assembly of the canopy support assembly 12, the second beam segment 30B rotates about the pivot axis P in the direction of arrow D to place the saddle 54 of the segment locking assembly 34 about the intermediate portion C of the first beam segment 30A. The saddle 54 prevents the further rotation of the second segment 30B about the pivot axis P. This includes preventing the rotation of the second beam segment 30B when a downward force F is applied to the upper portion of the canopy 14 or beam 24 such that may occur due to hanging something from a beam or from wind.

As shown, the segment coupler 32 can include a pivoting fastener 52 and one or more through holes 55. The pivoting fastener 52 can be any suitable fastener including a bolt and nut assembly, by way of example. More than one through hole 55 can be positioned along the intermediate portion B of the second beam segment 30B. In this manner, the amount of overlap A can be adjusted that can provide for varying the length of the beam 24 and/or varying the peak height of the canopy support assembly 12.

Figure 6:
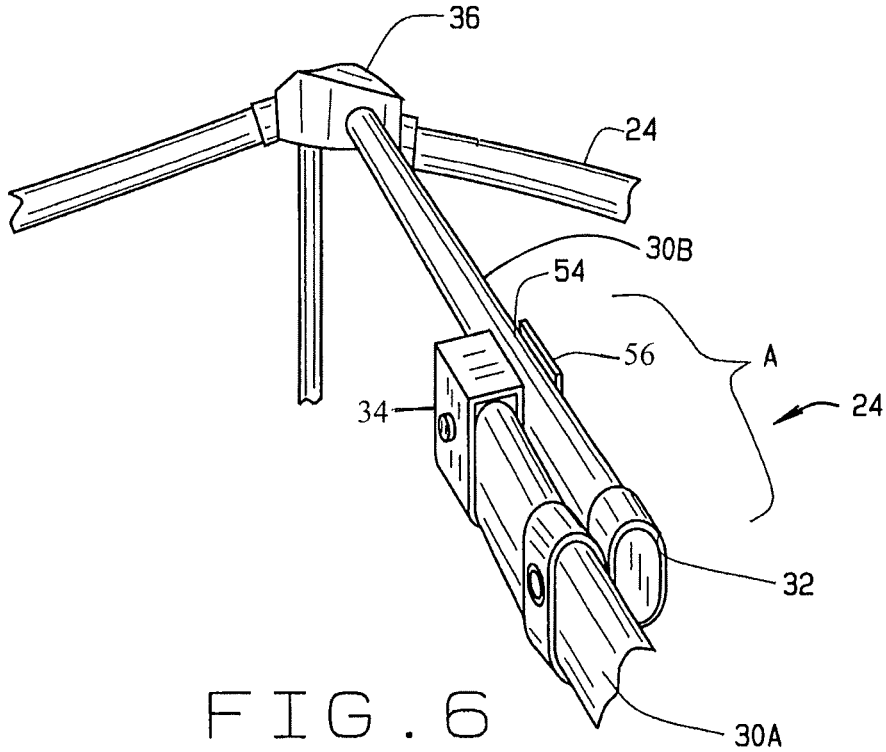
FIG. 6 is a perspective view of a canopy support structure having a canopy support beam with two segments and a hub according to a second exemplary embodiment.
Figure 7:
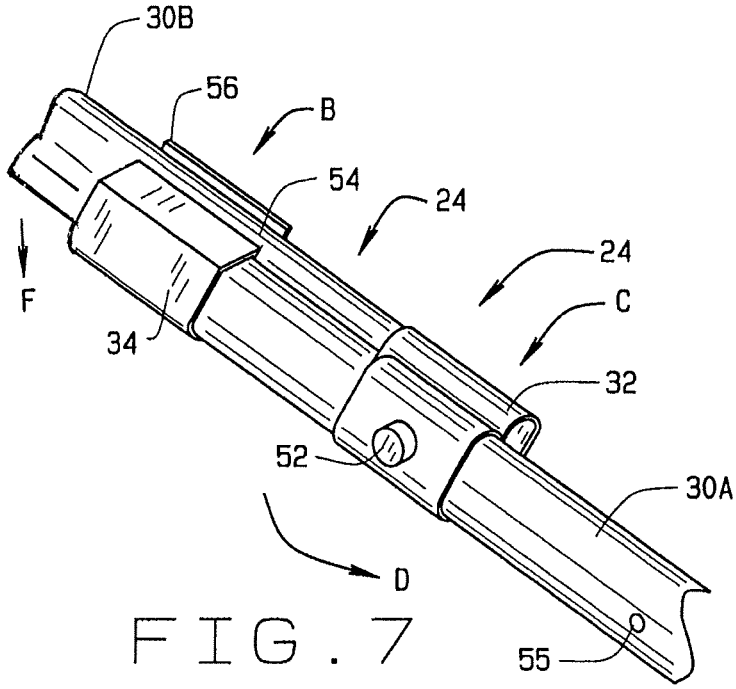
FIG. 7 is a side perspective view of a canopy support beam having two segments coupled with a pivotal segment coupler and a locking assembly according to the exemplary embodiment of FIG. 6.

FIG. 4 also illustrates one exemplary embodiment for attaching a plurality of beams 30 together by a hub 36 to form the peak of the canopy support assembly 12. As shown, each second beam segment 30B is pivotally coupled to the hub 36 for ease in erecting and collapsing the canopy support assembly 12. In other embodiments, the hub 36 may be releasably attached to each second beam segment 30B In another exemplary embodiment, the segment coupler 32 can be attached proximate to an end of the second beam segment 30B and at a distance from an end of the first beam segment 30A. One such embodiment is illustrated in FIGS. 6 and 7. As shown in this example, the first beam segment 20A includes a first end attached to the bracket coupler 42 (not shown) and a second end configured with the locking segment assembly 34. The pivotable segment coupler 32 is attached to the end of the second beam segment 30B and pivotally couples to the intermediate portion C of the first beam segment 30A. In this exemplary embodiment, the arrangement of the beam 24 for coupling the first beam segment 30A to the second beam segment 30B is the reverse of the exemplary embodiment illustrated in FIGS. 4 and 5 and as discussed above. However, the structure and operation of the multi-segmented beam 24 functions in a similar manner. Of course other assemblies and coupling mechanisms for the segment coupler 32 and the segment locking assembly 34 for coupling multiple segments 30 together are also considered to be within the scope of this disclosure.

Figure 8:
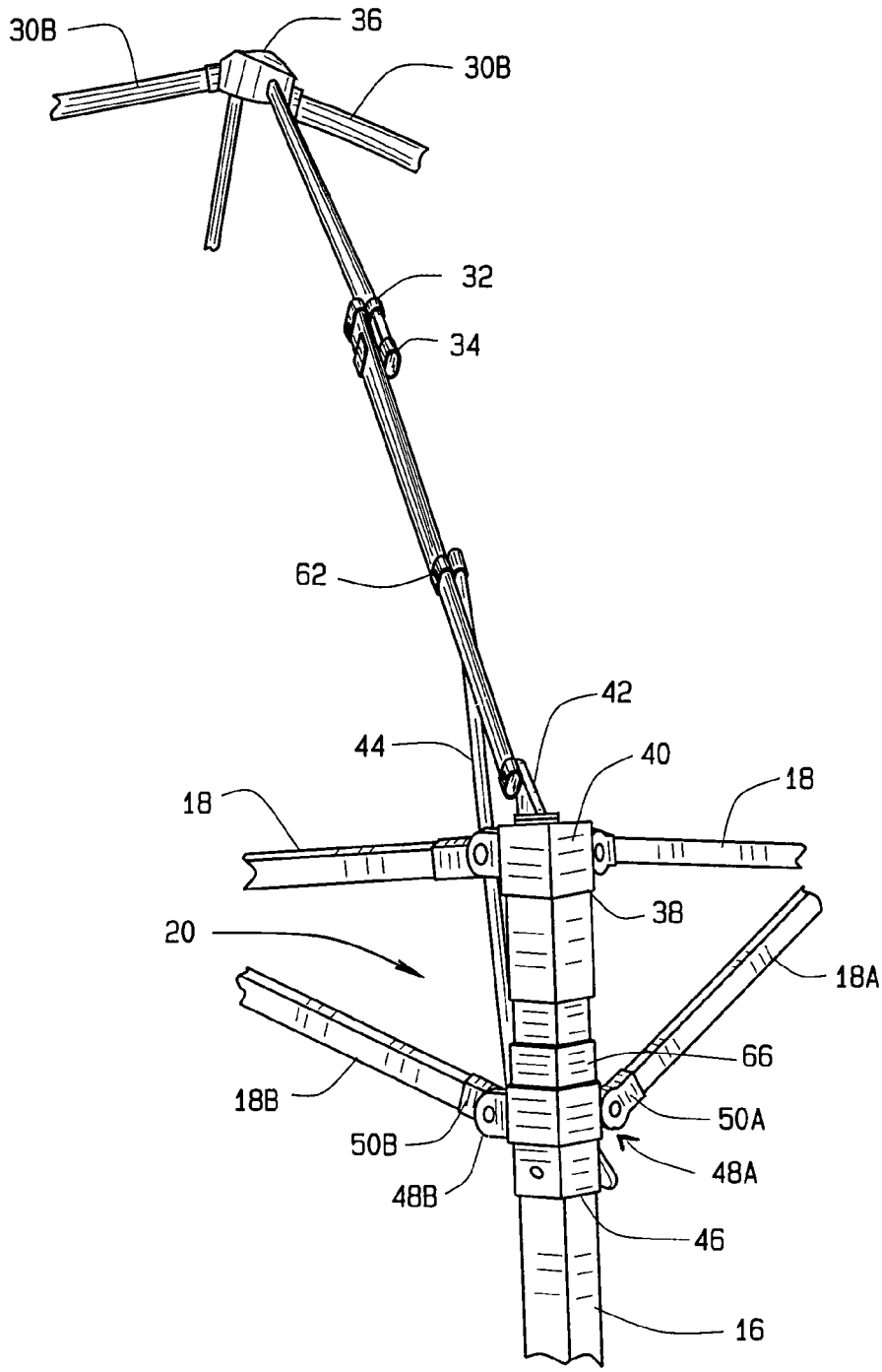
FIG. 8 is a side perspective view of a leg assembly with attached side supports, canopy support beam, sliding member and strut member for a canopy support structure in the erected canopy position according another embodiment.

Referring now to FIG. 8, another perspective view illustrates the coupling of the beam 24 to the coupler 42 of bracket 38. In this embodiment, a strut member 44 is pivotally attached to the first beam segment 30A with a pivoting strut coupler 62. The pivoting strut coupler 62 can be fixed in a position along beam 24 or in some embodiments as described above, can be adjustable to enable, at least in part, the adjustment of the height of the peak of the canopy support assembly 12.

Figure 9A:
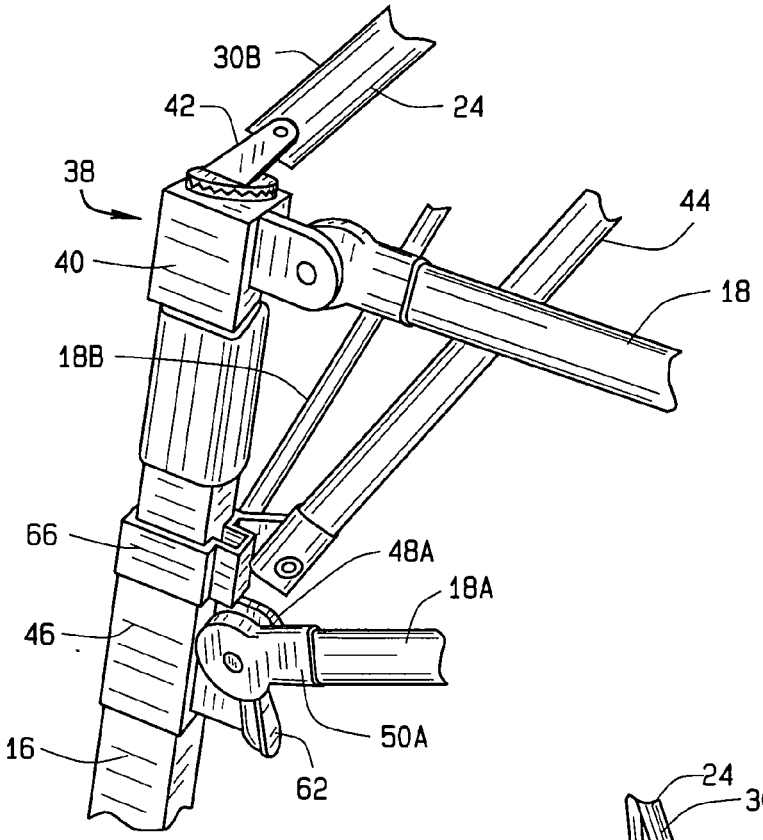
FIGS. 9A and 9B are close up perspective views of an upper end of a leg assembly and bracket in an erected canopy support structure according to the exemplary embodiment of FIG. 8.
Figure 9B:
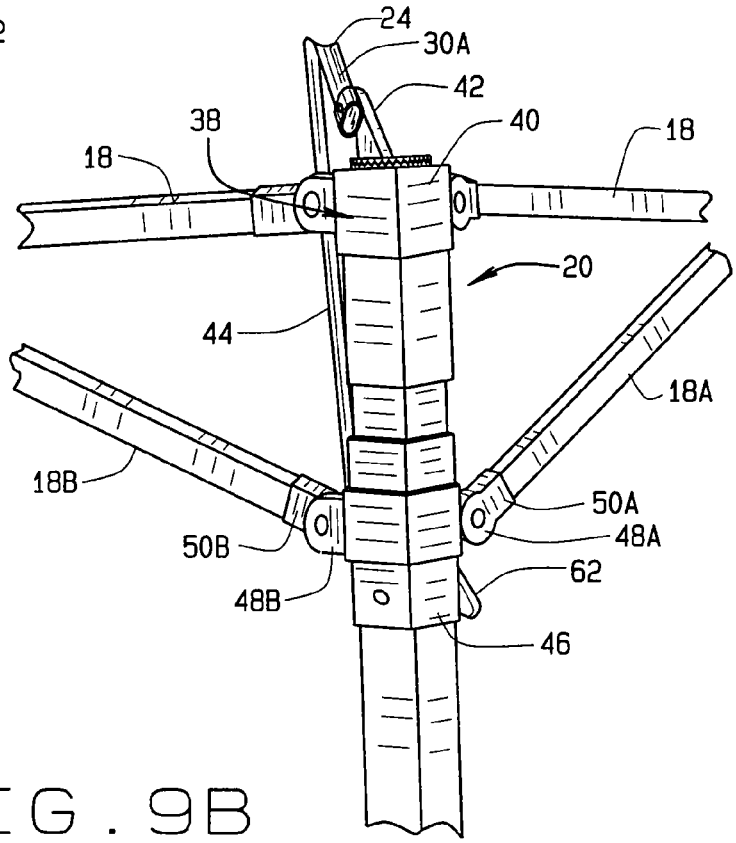
Figure 10B:
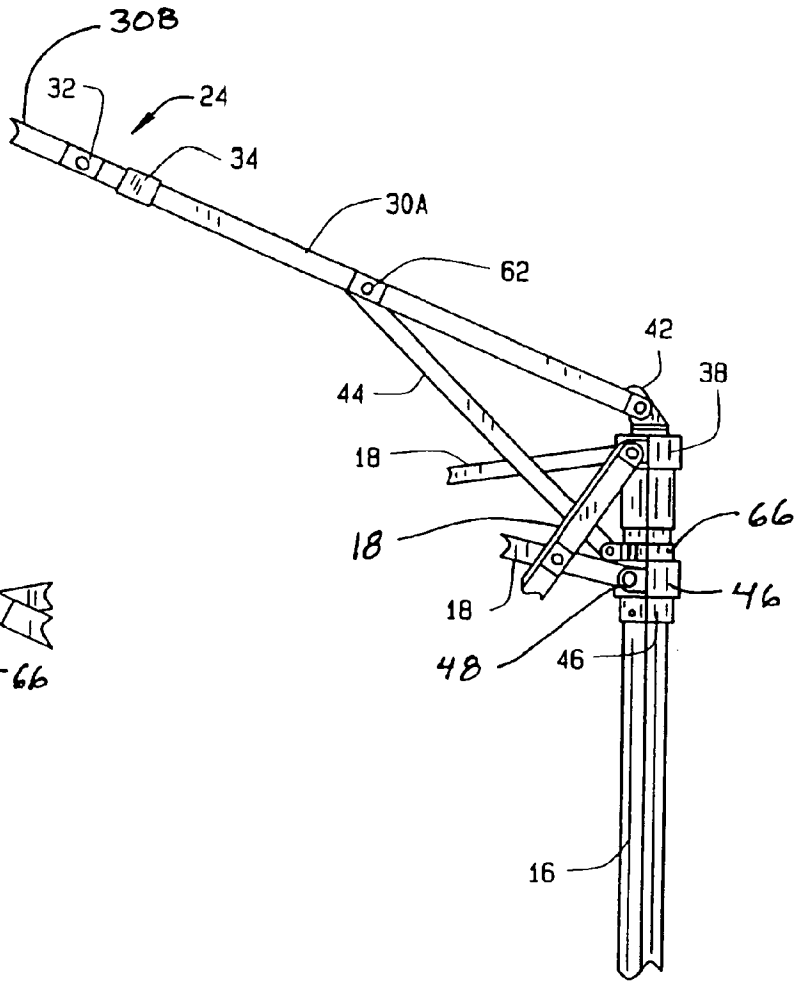
FIGS. 10A and 10B are perspective views of a leg assembly with attached side supports, canopy support beam and strut member for an erected canopy support structure according to another embodiment.
Figure 10A:
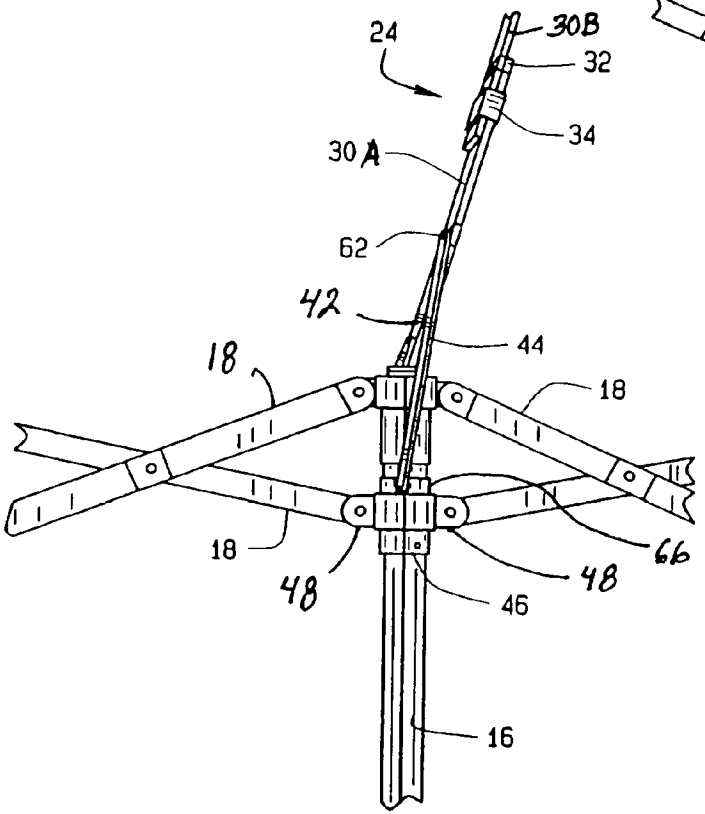

FIGS. 9A and 9B provide additional embodiments for coupling the side supports 18, beams 24, and strut member 44 to each leg 16. As shown, the bracket 38 is mounted to the top end of the leg 16 via base 40. The bracket 38 includes, in this embodiment, the coupler 42 that is fixed to the base 40 and is configured for pivotally attaching to an end of the beam 24. As shown in FIG. 9B, the coupler 42 is angled inward towards a center of the canopy and along a line of the attached beam 24. The beam 24 is attached for pivoting along a plane that is parallel to the axis of the leg 16 but is not pivotable in other directions. As noted above, in other embodiments, the coupler 42 can be attached to the base 40 in a manner that enables rotation about the axis of the leg 16. The bracket 38 also includes pivotal connectors for connecting to the upper arms of each side support 18A and 18B. The sliding member 46 is illustrated in the erected upper position for pivotally supporting the lower arms of the two side supports 18A and 18B. As shown in FIG. 9A, the sliding member 46 can include a user operated locking mechanism 64 for selectively securing the sliding member 46 in the erected position.

In this embodiment, the strut member 44 is pivotally coupled to a strut sliding member 66. In this manner, the adjustable movement of the lower end of the strut member 44 is separate from and independent of the position and movement of the sliding member 46 that supports the lower arms of the side supports 18A and 18B.

As shown by the various exemplary embodiments herein, the canopy support assembly 12 can provide for supporting heavier loads and providing a stronger structure to endure forces exerted on the canopy support assembly and the canopy 14. The multi-segment beams 24 are configured for collapsing for storage and transport, but for forming a strong beam 24 that can support heaver loads and downward and lateral forces without unnecessarily changing the shape of the perimeter or covered area of the canopy 14. The segment couplers 32 and segment locking assemblies 34 restrict these applied forces and transfer the forces to the legs 16. Additionally, in some embodiments adjustable segment couplers 32, segment locking assemblies 34 and strut members 44 can provide for adjusting the height of the peak of the canopy support assembly 12.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A collapsible canopy support assembly comprising:

a plurality of legs having upper and lower ends;

a side support positioned between each adjacent leg, where each of the plurality of legs is associated with a first side support and a second side support;

a plurality of beams having first and second ends and adapted for supporting a canopy, each beam having a plurality of elongated beam segments coupled together to form the beam, a segment coupler pivotally coupling an end of a first beam segment to an intermediate portion of a second beam segment in a substantially linear plane defined by the first beam segment and the second beam segment with the first beam having an overlapping portion with the second beam segment and being in a lateral side by side position thereto, and a segment locking assembly adapted for selectively securing the first beam segment relative to the second beam segment in a fixed position in the substantially linear plane when in an assembled position, the segment locking assembly attached to an end of the second beam segment and selectively securing an intermediate portion of the first beam segment in the fixed substantially planar position and laterally securing the end of the second beam segment to the intermediate portion of the first beam segment adjacent to the overlapped portion of the first beam segment, wherein the segment coupler is configured for positioning at multiple intermediate positions along the intermediate portions of the second beam segment at multiple distances from an end of the second beam segment for varying a length of the first overlapping portion, and the length of each beam, and wherein the segment coupler is slidable along the intermediate portion of the second beam segment and the intermediate portion of the second beam segment includes a plurality of lateral holes defining the multiple distances and the segment coupler includes a removable pivoting fastener aligned for engagement one at a time each of the lateral holes;

a hub adapted for attaching to the first end of each beam and securing the first ends of the beams relative to each other; and a bracket mounted to the upper end of each leg, the bracket having a base adapted for attaching to the leg and a coupler for attaching to the second end of a beam.

2. The assembly of claim 1 wherein the base is fixed relative to the leg and the coupler is fixed in relation to the base.

3. The assembly of claim 1 wherein each leg defines an axis and wherein the base is fixed relative to the axis and the coupler is selectively rotatable about the axis and fixed axially to the axis and wherein the second end of the beam is pivotally coupled to the coupler in a plane that includes the axis.

4. The assembly of claim 1 wherein the first beam segment includes a first end pivotally attached to the bracket coupler and a second beam end and wherein the segment coupler is attached proximate to the second end of the first beam segment, wherein the second beam segment includes a first end and a second end and wherein the segment coupler is attached distal to the first end of the second beam segment and the second end of the second beam segment is releasably attached to the hub.

5. The assembly of claim 4 wherein the segment locking assembly includes a saddle fixed proximate to the first end of the second beam segment for receiving in the substantially planar position during erection of the canopy support assembly the first beam segment distal from the second end of the first beam segment, and the saddle having two opposing sides restricting the lateral movement of the received first beam segment.

6. The assembly of claim 5 wherein a side portion of the second beam segment defines the first opposing side of the saddle and the saddle includes a finger defining a second opposing side for receiving a portion of the cross-section of the first beam segment.

7. The assembly of claim 5 wherein the a side portion of the saddle defines a first opposing portion and an opposing lateral side spaced laterally apart from the first opposing portion defining a u-shaped channel therebetween to receive a substantial portion of the cross-section of the first beam segment.

8. The assembly of claim 1 wherein the first beam segment includes a first end attached to the bracket coupler and a second end and wherein the segment coupler is attached distal to the second end of the first beam segment, wherein the second beam segment includes a first end and a second end and wherein the segment coupler is attached proximate to the first end of the second beam segment and the second end of the second beam segment is releasably attached to the hub.

9. The assembly of claim 8 wherein the segment locking assembly includes a saddle fixed proximate to the first end of the first beam segment for receiving in the substantially planar position during erection of the canopy support assembly the second beam segment distal from the first end of the second beam segment, and the saddle having two opposing sides restricting the lateral movement of the received second beam segment.

10. The assembly of claim 9 wherein a side portion of the first beam segment defines the first opposing side of the saddle and the saddle includes a finger defining a second opposing side for receiving a portion of the cross-section of the second beam segment.

11. The assembly of claim 9 wherein the a side portion of the saddle defines a first opposing portion and an opposing lateral side spaced laterally apart from the first opposing portion defining a u-shaped channel therebetween to receive a substantial portion of the cross-section of the second beam segment.

12. The assembly of claim 1 wherein the hub is configured for releasably and pivotally attaching to each beam.

13. The assembly of claim 1 wherein each side support has first and second ends and each end includes an upper connector and a lower connector, a fixed support mounted near the top of each leg and having a first coupler for attaching the upper connector of the first side support and a second coupler for attaching the upper connector of the second side support, and a slidable member slidably connected to each leg and being movable between a first position for canopy storage and a second position for canopy deployment, the slidable member having a first coupler for attaching the lower connector of the first side support and a second coupler for attaching the lower connector of the second side support.

14. The assembly of claim 1 wherein each side support includes a scissors x-shaped frame.

15. The assembly of claim 1, further comprising a strut member coupling an intermediate portion of the each beam to an intermediate portion of a leg.

16. The assembly of claim 15 wherein the strut member is pivotally coupled to the intermediate portion of each beam.

17. The assembly of claim 15, further comprising a sliding member slidably coupled to each leg and a locking member configured for locking the sliding member in a fixed position for deployment of the canopy, wherein the strut member is pivotally coupled to the sliding member.

18. The assembly of claim 15, further comprising a strut coupler configured for adjustably attaching the strut member to multiple positions along the intermediate portion of the beam.

19. The assembly of claim 1 wherein the segment locking assembly includes an outer ring that encircles the end of the first beam segment and is fixedly attached thereto.

20. A collapsible canopy support assembly having a plurality of legs having upper and lower ends, a side support positioned between each adjacent leg, a plurality of beams having first and second ends and adapted for supporting a canopy, each beam having a plurality of elongated beam segments coupled together to form the beam, a bracket mounted to the upper end of each leg, the bracket having a base adapted for attaching to the leg and a coupler for attaching to the second end of a beam, a hub adapted for attaching to the first end of each canopy beam and releasably securing the first ends of the beams relative to each other, the assembly further comprising:

a segment coupler for pivotally coupling an end of a first beam segment relative to an intermediate portion of a second beam segment in a substantially planar position the plane of which is defined by the first beam segment and the second beam segment with the first beam segment having an overlapping portion with the second beam segment and being in a lateral side by side position thereto, wherein the segment coupler is configured for positioning at multiple intermediate positions along the intermediate portions of the second beam segment at multiple distances from an end of the second beam segment for varying a length of the overlapping portion of the first beam segment with the second beam segment, and the length of each beam, and wherein the segment coupler is slidable along the intermediate portion of the second beam segment and the intermediate portion of the second beam segment includes a plurality of lateral holes defining the multiple distances and the segment coupler includes a removable pivoting fastener aligned for engagement one at a time each of the lateral holes; and a segment locking assembly adapted for selectively securing the first beam segment relative to the second beam segment in a fixed position in the substantially planar position when in an assembled position, the segment locking assembly attached to an end of the second beam segment and selectively securing an intermediate portion of the first beam segment in the fixed substantially planar position and laterally securing the end of the second beam segment to the intermediate portion of the first beam segment adjacent to the overlapped portion of the first beam segment.

21. The assembly of claim 20 wherein the first beam segment includes a first end pivotally attached to the bracket coupler in a plane defined by a leg and a second end and wherein the segment coupler is attached proximate to the second end of the first beam segment, and wherein the second beam segment includes a first end and a second end and wherein the segment coupler is attached distal to the first end of the second beam segment and the second end of the second beam segment is releasably attached to the hub.

22. The assembly of claim 21 wherein the segment locking assembly includes a laterally protruding finger with an opposing vertical side spaced apart from the second beam segment and defining a saddle therebetween and fixed proximate to the first end of the second beam segment and adapted for receiving in the substantially planar position a portion of the cross-section of the first beam segment distal from the second end of the first beam segment during erection of the canopy assembly.

23. The assembly of claim 20 wherein the first beam segment includes a first end attached to the bracket coupler in a plane including a leg and a second end and wherein the segment coupler is attached distal to the second end of the first beam segment and the second beam segment includes a first end and a second end and wherein the segment coupler is attached proximate to the first end of the second beam segment and the second end of the second beam segment is releasably attached to the hub.

24. The assembly of claim 23 wherein the segment locking assembly includes a laterally protruding finger with an opposing vertical side spaced apart from the first beam segment and defining a saddle therebetween and fixed proximate to the second end of the first beam segment and adapted for receiving in the substantially planar position a portion of the cross-section of the second beam segment distal from the first end of the first beam segment during erection of the canopy assembly.

25. The assembly of claim 20, further comprising a strut member coupling an intermediate portion of the each beam to an intermediate portion of a leg.

26. The assembly of claim 25 wherein the strut member is pivotally coupled at least one of the beam and the leg.

27. The assembly of claim 25, further comprising a sliding member slidably coupled to each leg and a locking member configured for locking the sliding member in a fixed position for deployment of the canopy, wherein the strut member is pivotally coupled to the sliding member.

28. The assembly of claim 27, further comprising a strut coupler configured for adjustably attaching the strut member to multiple positions along the intermediate portion of the beam and wherein the segment coupler is configured for attaching to multiple positions along the beam, the adjustable strut coupler and the adjustable segment coupler being configured for varying a peak height of the canopy.

29. The assembly of claim 20 wherein the segment locking assembly includes an outer ring that encircles the end of the first beam segment and is fixedly attached thereto.

30. A collapsible canopy support assembly having a plurality of legs having upper and lower ends, a side support positioned between each adjacent leg, a plurality of beams having first and second ends and adapted for supporting a canopy, each beam having a plurality of elongated beam segments coupled together to form the beam, a bracket mounted to the upper end of each leg, the bracket having a base adapted for attaching to the leg and a coupler for attaching to the second end of a beam, a hub adapted for attaching to the first end of each canopy beam and releasably securing the first ends of the beams relative to each other, the assembly further comprising:

a segment coupler for pivotally coupling an end of a first beam segment relative to an intermediate portion of a second beam segment in a substantially planar position the plane of which is defined by the first beam segment and the second beam segment with the first beam segment having an overlapping portion with the second beam segment and being in a lateral side by side position thereto; and a segment locking assembly adapted for selectively securing the first beam segment relative to the second beam segment in a fixed position in the substantially planar position when in an assembled position, the segment locking assembly attached to an end of the second beam segment and selectively securing an intermediate portion of the first beam segment in the fixed substantially planar position and laterally securing the end of the second beam segment to the intermediate portion of the first beam adjacent to the overlapped portion of the first beam segment;

a strut member coupling an intermediate portion of the each beam to an intermediate portion of a leg;

a sliding member slidably coupled to each leg and a locking member configured for locking the sliding member in a fixed position for deployment of the canopy, wherein the strut member is pivotally coupled to the sliding coupler; and a strut coupler configured for adjustably attaching the strut member to multiple positions along the intermediate portion of the beam and wherein the segment coupler is configured for attaching to multiple positions along the beam, the adjustable strut coupler and the adjustable segment coupler being configured for varying a peak height of the canopy.

31. The assembly of claim 30 wherein the first beam segment includes a first end pivotally attached to the bracket coupler in a plane defined by a leg and a second end and wherein the segment coupler is attached proximate to the second end of the first beam segment, and wherein the second beam segment includes a first end and a second end and wherein the segment coupler is attached distal to the first end of the second beam segment and the second end of the second beam segment is releasably attached to the hub.

32. The assembly of claim 31 wherein the segment locking assembly includes a laterally protruding finger with an opposing vertical side spaced apart from the second beam segment and defining a saddle therebetween and fixed proximate to the first end of the second beam segment and adapted for receiving in the substantially planar position a portion of the cross-section of the first beam segment distal from the second end of the first beam segment during erection of the canopy assembly.

33. The assembly of claim 30 wherein the first beam segment includes a first end attached to the bracket coupler in a plane including a leg and a second end and wherein the segment coupler is attached distal to the second end of the first beam segment and the second beam segment includes a first end and a second end and wherein the segment coupler is attached proximate to the first end of the second beam segment and the second end of the second beam segment is releasably attached to the hub.

34. The assembly of claim 33 wherein the segment locking assembly includes a laterally protruding finger with an opposing vertical side spaced apart from the first beam segment and defining a saddle therebetween and fixed proximate to the second end of the first beam segment and adapted for receiving in the substantially planar position a portion of the cross-section of the second beam segment distal from the first end of the first beam segment during erection of the canopy assembly.

35. The assembly of claim 30 wherein the strut member is pivotally coupled at least one of the beam and the leg.

36. The assembly of claim 30 wherein the segment locking assembly includes an outer ring that encircles the end of the first beam segment and is fixedly attached thereto.

37. The assembly of claim 30 wherein the segment coupler is configured for positioning at multiple intermediate positions along the intermediate portions of the second beam segment at multiple distances from an end of the second beam segment for varying a length of the first overlapping portion, and the length of the beam.

38. The assembly of claim 37 wherein the segment coupler is slidable along the intermediate portion of the second beam segment and the intermediate portion of the second beam segment includes a plurality of lateral holes defining the multiple distances and the segment coupler includes a removable pivoting fastener aligned for engagement one at a time each of the lateral holes.

* * * * *